US008256978B2

(12) United States Patent
Bencsics et al.

(10) Patent No.: US 8,256,978 B2
(45) Date of Patent: Sep. 4, 2012

(54) KIT FOR DISPENSING VISCOUS FLUID FROM A CONTAINER

(75) Inventors: John Bencsics, Goshen, IN (US); Trevor Jackson, Kirtland, OH (US); Patrick J. Coyne, Shaker Heights, OH (US); Don Krabill, Elkhart, IN (US)

(73) Assignee: Geocel Corporation, Elkhart, IN (US)

( * ) Notice: Subject to any disclaimer, the term of this patent is extended or adjusted under 35 U.S.C. 154(b) by 1218 days.

(21) Appl. No.: 11/954,054

(22) Filed: Dec. 11, 2007

(65) Prior Publication Data

US 2008/0145138 A1 Jun. 19, 2008

Related U.S. Application Data

(60) Provisional application No. 60/874,775, filed on Dec. 13, 2006.

(51) Int. Cl.
*A46B 11/00* (2006.01)

(52) U.S. Cl. ..... 401/268; 401/261; 401/16; 401/25; 15/256.5

(58) Field of Classification Search ..... 401/261, 401/265, 266, 268, 270, 16, 18, 25, 24; 222/566, 222/567, 570; 15/256.5
See application file for complete search history.

(56) References Cited

U.S. PATENT DOCUMENTS

| | | | | |
|---|---|---|---|---|
| 2,982,987 | A * | 5/1961 | Knapp | 401/139 |
| 4,382,530 | A * | 5/1983 | Calisto | 222/567 |
| 5,054,159 | A * | 10/1991 | Richardson | 15/400 |
| 5,346,380 | A * | 9/1994 | Ables | 425/87 |
| 5,865,555 | A * | 2/1999 | Dawson | 401/266 |

* cited by examiner

*Primary Examiner* — David Walczak
(74) *Attorney, Agent, or Firm* — Barnes & Thornburg LLP

(57) ABSTRACT

A kit for dispensing a viscous fluid from a container comprising: a nozzle for coupling to an outlet of the container defining a nozzle opening for dispensing the viscous fluid from the container, the nozzle including applicator engaging structure; and an applicator including a working area and nozzle engaging structure releasably engageable with the applicator engaging structure of the nozzle to releasably secure the applicator to the nozzle. The applicator further including a working area for spreading the viscous fluid dispensed by the nozzle. The kit also including another applicator and the nozzle may be selectively engageable with either of the two applicators. The applicators may be in the form of a spatula applicator and a brush applicator or may be in any other suitable form.

16 Claims, 4 Drawing Sheets

KIT FOR DISPENSING VISCOUS FLUID FROM A CONTAINER

CROSS REFERENCE TO RELATED APPLICATIONS

This Application claims priority from U.S. Provisional Patent Application 60/874,775 filed Dec. 13, 2006, the contents of all of which are incorporated by reference.

The present disclosure relates to a kit for dispensing viscous fluid from a container.

BACKGROUND

Application of viscous fluid in the construction or repair industries, such as any type of sealant, epoxy, caulk, adhesive, floor glue or the like, to a roof, floor, ceiling, wall or other surface requires different types of tools depending upon the location, size, and configuration of the surface and the position, size and configuration of any flaws in the surface. Moreover, oftentimes, the surface can be difficult to reach either because of its configuration or because of the physical location of the surface. Further, the challenges in applying viscous fluids to surfaces not only include reaching or arriving at the location of the surface to be treated, but having the right applicator tools available at the location even though the type of applicator tools needed might not be known until the location is reached.

SUMMARY

The present disclosure relates to a kit for dispensing a viscous fluid from a container comprising: a nozzle for coupling to an outlet of the container defining a nozzle opening for dispensing the viscous fluid from the container and an applicator releasably securable to the nozzle. The nozzle includes applicator engaging structure and the applicator includes nozzle engaging structure releasably engageable with the applicator engaging structure of the nozzle to releasably secure the applicator to the nozzle. The applicator also includes a working area for spreading the viscous fluid dispensed by the nozzle.

The kit also includes an other applicator and the nozzle is selectively engageable with either of the two applicators. The other applicator also includes nozzle engaging structure releasably engageable with the applicator engaging structure of the nozzle to releasably secure the second applicator to the nozzle. The other applicator also includes a working area and the working areas of the two applicators are different.

One of the applicators may be in the form of a spatula applicator with its working area having beveled leading edge. The other applicator may be in the form of a brush applicator with its working area including a plurality of bristles. Either or both applicators may be in any other suitable form in accordance with other embodiments of the present disclosure.

Features and advantages of the disclosure will be set forth in part in the description which follows and the accompanying drawings described below, wherein an embodiment of the disclosure is described and shown, and in part will become apparent upon examination of the following detailed description taken in conjunction with the accompanying drawings.

BRIEF DESCRIPTION OF THE DRAWINGS

The present invention and the advantages thereof will become more apparent upon consideration of the following detailed description when taken in conjunction with the accompanying drawings.

DETAILED DESCRIPTION

Figure 1:
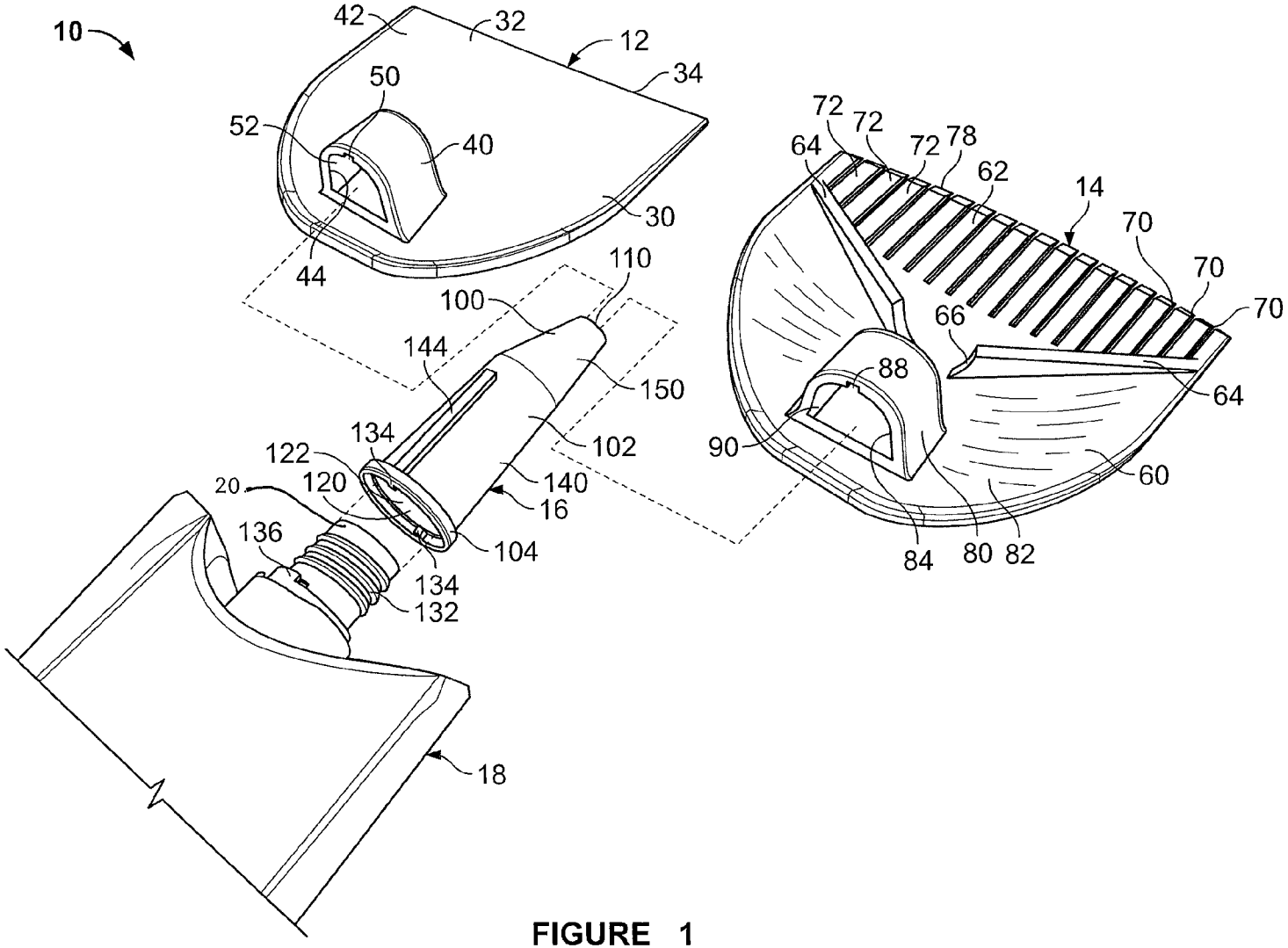
FIG. 1 is an exploded view of a spatula applicator, a brush applicator, and nozzle engageable with a container for dispensing viscous fluid from the container and selectively engageable with the spatula applicator and the brush applicator for applying the viscous fluid to a surface.
Figure 2:
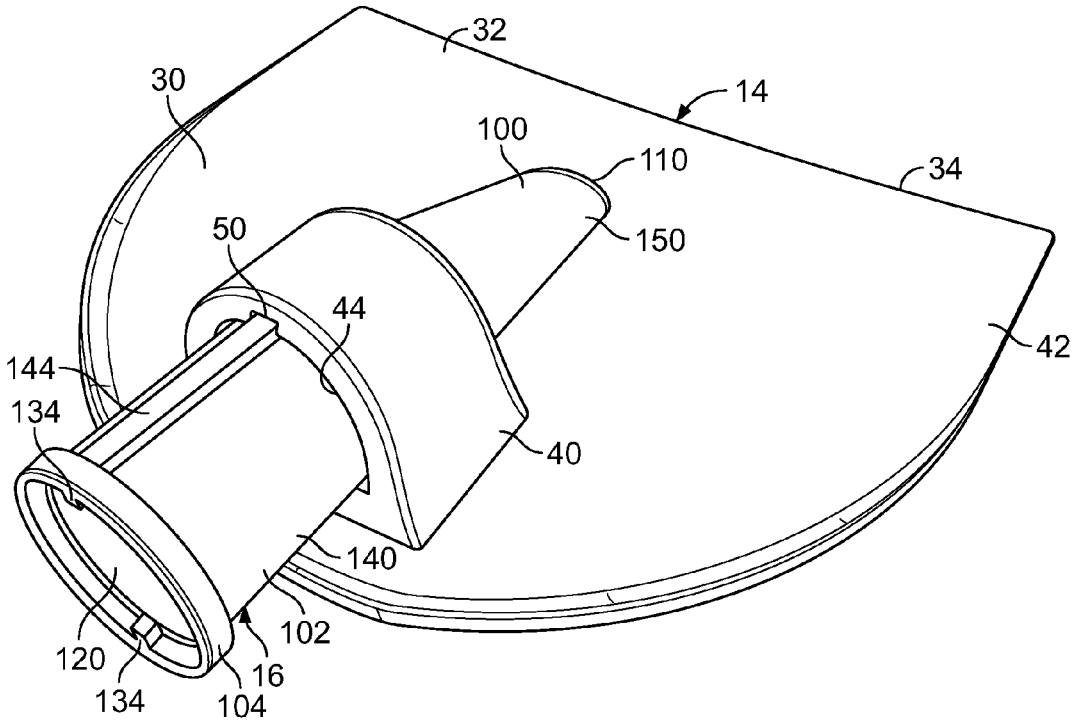
FIG. 2 is a perspective view of the nozzle engaged with the spatula applicator of FIG. 1.
Figure 3:
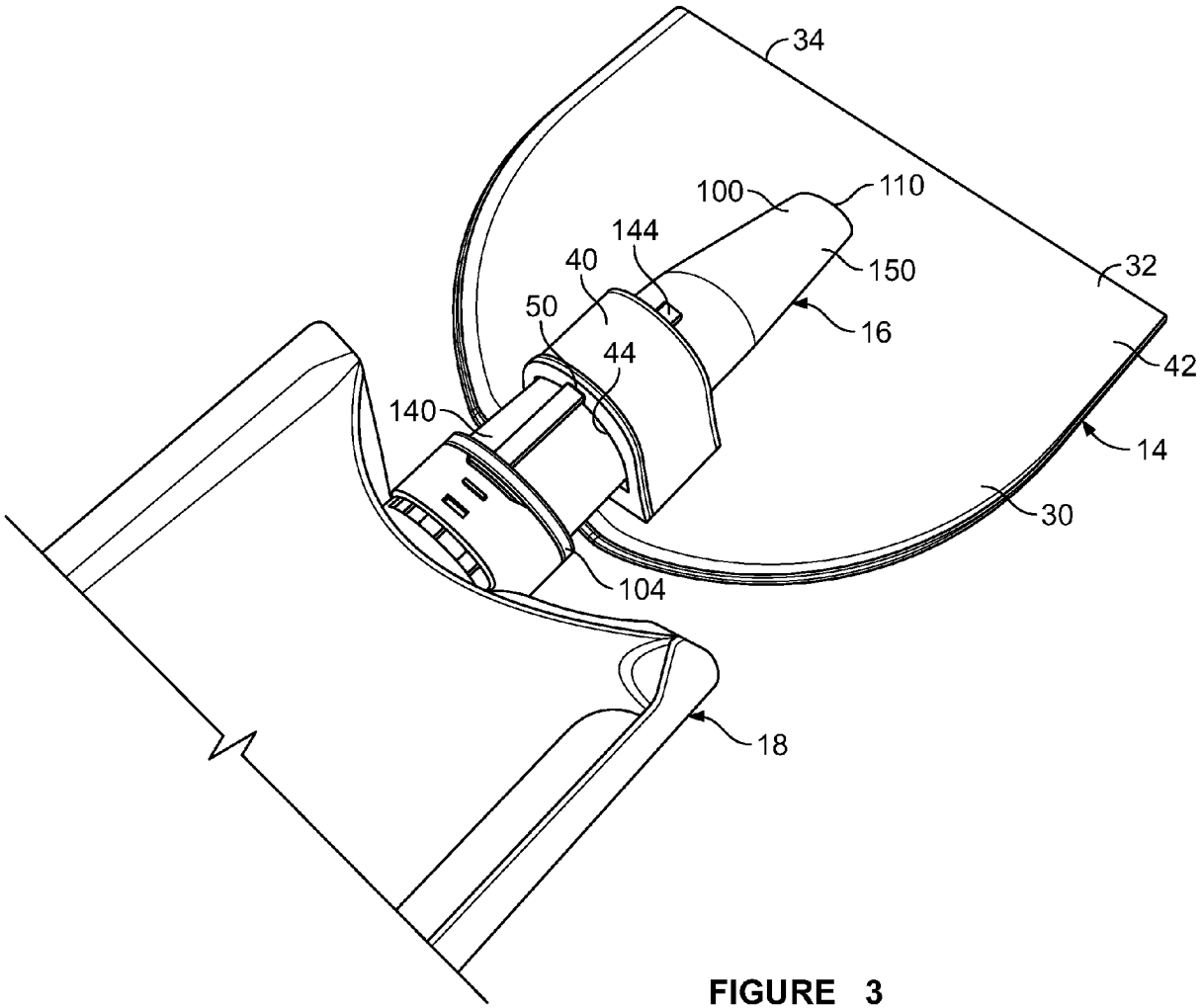
FIG. 3 is a perspective view of the nozzle and spatula applicator of FIG. 2 illustrating the nozzle engaged with the spout of the container.
Figure 4:
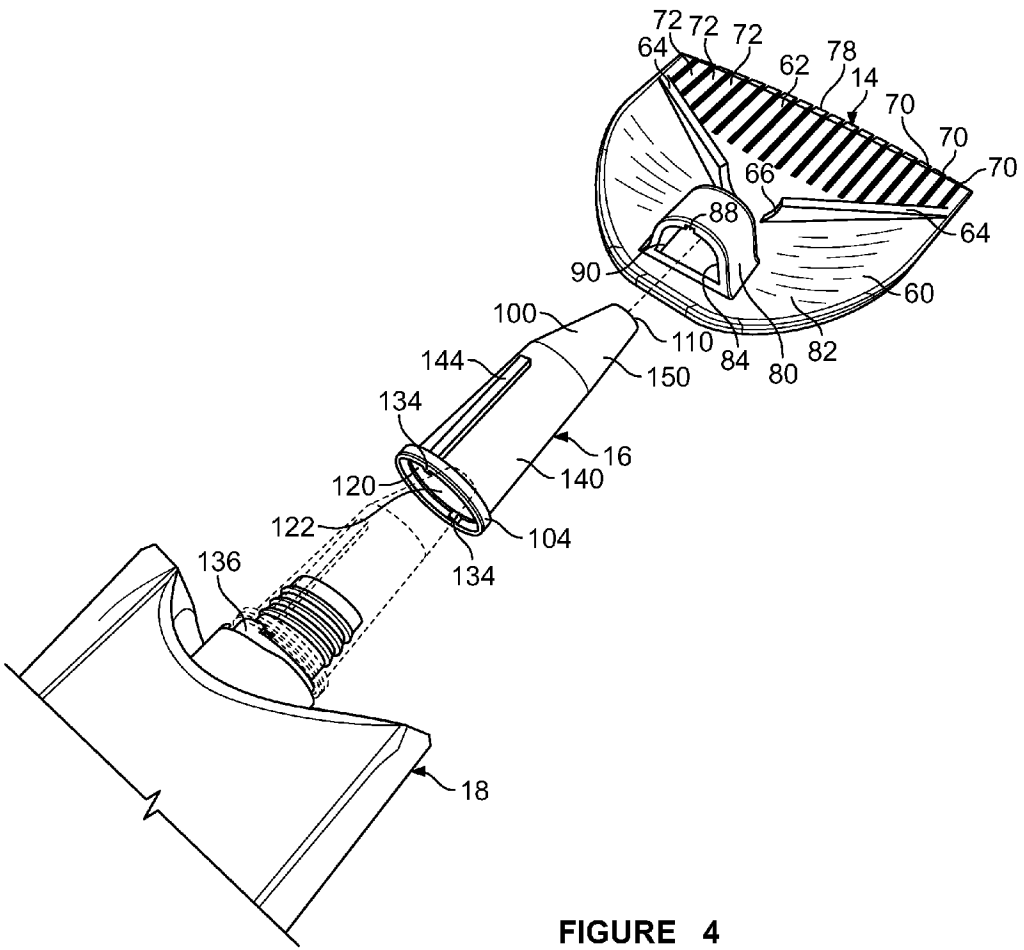
FIG. 4 is an exploded perspective view of the nozzle, brush applicator and container of FIG. 1, also illustrating with dashed lines the nozzle engaged with the spout of the container.

FIGS. 1-4 illustrate a kit spatula applicator 12, a brush applicator 14 and a nozzle 16 selectively engageable with the spatula applicator and the brush applicator in accordance with an embodiment of the present disclosure, and a container 18 of viscous fluid having a spout 20 engageable with the nozzle for dispensing the viscous fluid from the container. The viscous fluid may be any type of sealant or the like, including epoxy, caulk, adhesive, etc. The illustrated container 18 may be in the form of any commercially-available container of sealant or the like or may have any other suitable construction. Similarly, the spout 20 of the container 18 may be in the form of any commercially-available spout or may have any other suitable construction.

The spatula applicator 12 includes an applicator body 30 that terminates in a working area 32 configured as a spatula. The applicator body 30 is generally cup shaped and is substantially flat. The leading edge 34 of the working area 32 is beveled, and extends linearly to facilitate smooth application of the viscous fluid. The spatula applicator 12 also includes nozzle engaging structure in the form of a rim 40 that protrudes from the side 42 of the applicator body 30. The rim 40 extends arcuately and continuously from the side 42, extending outward from the side and curving back to the side. The rim 40 defines an opening 44 for receiving the nozzle 16 and also defines a slot 50 on the inner surface 52 of the rim at or near the center of the rim. The opening 44 defined by the rim 40 is bell shaped. The slot 50 has a generally rectangular or square cross section and extends along the entire width of the rim 40. The spatula applicator 12, including the nozzle engaging structure, may have any other suitable construction in accordance with other embodiments of the present disclosure.

The brush applicator 14 includes an applicator body 60 that terminates in a working area 62 in the form of a brush. The applicator body 60 is generally cup shaped, but curved along its width. The brush applicator 14 also includes a pair of reinforcing ribs 64 extending at an angle from the side edges of the applicator body 60 and protruding from the applicator body. The reinforcing ribs 64 define a channel 66 for receiving the nozzle 16 when the nozzle is engaged with the brush applicator 14. The working area 62 of the brush applicator 14 defines a plurality of slits 70 forming bristles 72 to form the brush and to facilitate brushing application of the viscous fluid. The leading edges of the bristles are beveled for application purposes. Additionally, the leading edge 78 of the working area 62 of the brush applicator 14 is arcuate along its expanse.

The brush applicator 14 also includes nozzle engaging structure in the form of a rim 80 that protrudes from the side 82 of the applicator body 60. The rim 80 extends arcuately and continuously from the side 82 of the applicator body 60, extending outward from the body and curving back to the side of the applicator body. The rim 80 defines an opening 84 for receiving the nozzle 16 and also defines a slot 88 on the inner surface 90 of the rim 80 at or near the center of the rim. The opening 84 defined by the rim 80 is generally bell shaped. The slot 88 has a generally square or rectangular cross section and extends along the entire width of the rim 80. The nozzle engaging structure of the brush applicator also includes the pair of reinforcing ribs 64 defining the channel 66. The brush applicator 14, including the nozzle engaging structure, may have any other suitable construction in accordance with other embodiments of the present disclosure.

The nozzle 16 includes a dispensing portion 100, a cylindrical portion 102 and a flange 104 disposed about the end of the cylindrical portion opposite the dispensing portion. The dispensing portion 100 terminates in an elliptic opening 110 and the cross section of the dispensing portion transitions from the cylindrical portion 102 to the elliptic opening 110. The center of the elliptic opening 110 is offset from the center longitudinal axis of the cylindrical portion 102. The nozzle 16 includes an inner wall 120 defining a channel 122 for dispensing the viscous fluid. The inner wall 120 includes a screw thread for mating with a complementary screw thread 132 on the container 18. The inner wall 120 also includes a pair of diametrically-opposed stops 134 to engage a pair of diametrically opposed stops 136 on the spout 20 of the container 18 for engaging the nozzle 16 with the spout 20 of the container 18.

The nozzle 16 includes applicator engaging structure comprising the outer surface 140 of the cylindrical portion 102 and a rib 144 formed on the outer surface. The rib 144 has a generally square or rectangular cross section and extends from the flange 104 in a direction parallel to the longitudinal axis of the cylindrical portion 102. To engage the nozzle 16 and either the spatula applicator 12 or the brush applicator 14, the cylindrical portion 102 of the nozzle 16 slides into and fits snugly within the opening 44 of the spatula applicator or the opening 84, the brush applicator 14, with the rib 144 sliding into and fitting snugly within the slot 50 of the spatula applicator 12 or the slot 88 of the brush applicator 14. When the nozzle 16 is engaged with the brush applicator 14, the dispensing portion 100 is also received by the channel 66 defined by the reinforcing ribs 64 of the brush applicator. Thus, in engaging the brush applicator 14, the applicator engaging structure of the nozzle also includes the outer surface 150 of the dispensing portion 100. The nozzle 16, including the nozzle engaging structure, can have any other suitable construction in accordance with other embodiments of the present disclosure.

Accordingly, in the illustrated embodiment, the nozzle engaging structures of the spatula applicator 12 and the brush applicator 14 are substantially identical to each other except that the brush applicator 14 further includes the pair of reinforcing ribs 64 defining the channel 66. The applicator engaging structure of the nozzle 16 is configured to engage either the nozzle engaging structure of the spatula applicator 12 or the nozzle engaging structure of the brush applicator 14. Thus, the nozzle 16 is selectively engageable with either the spatula applicator 12 or the brush applicator 14. As a result, the dispensed viscous fluid can be readily applied with either the spatula applicator 12 or the brush applicator 14 and, further, either applicator 12 or 14 can be readily replaced with the other applicator 12 or 14 depending upon the needs.

Any other suitable applicator for applying viscous fluid dispensed from the container 18 can be used instead of or in addition to the spatula applicator 12 and instead of or in addition to the brush applicator 14. Further, such other applicators for applying viscous fluid can have any other suitable construction and can include any other suitable working areas in accordance with other embodiments of the present disclosure.

The spatula applicator 12, brush applicator 14 and the nozzle 16 in accordance with the present disclosure provide several advantages. For example, the applicators 12 and 14 and nozzle 16 can be readily carried to the location where the viscous fluid is to be applied. Further, once at the location, the different applicators 12 and 14 provide different and readily-available options to apply the viscous fluid. Such advantages can be especially valuable where, as often is the case, the location where viscous fluid is to be applied may be difficult to reach, such as, for example, a roof, or such other location that is difficult to reach because of its physical location or because of obstructions, and the type of applicators needed cannot be determined until the location is reached.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the disclosure are desired to be protected. The description and figures are intended as illustrations of embodiments of the disclosure, and are not intended to be construed as having or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

What is claimed is:

1. A kit for dispensing a viscous fluid from a container comprising:

(a) a nozzle for coupling to an outlet of the container defining a nozzle opening for dispensing the viscous fluid from the container, the nozzle including applicator engaging structure;

(b) a first applicator including nozzle engaging structure releasably engageable with the applicator engaging structure of the nozzle to releaseably engage the first applicator and the nozzle, the first applicator further including a first working area configured to spread the viscous fluid the first working area having a leading edge that is distal of the nozzle when the first applicator is releasably engaged with the nozzle; and (c) a second applicator including nozzle engaging structure releasably engageable with the applicator engaging structure of the nozzle to releaseably engage the second applicator and the nozzle, the second applicator further including a second working area configured to spread the viscous fluid, the second working area having a leading edge that is distal of the nozzle engaging structure of the second applicator when the second applicator is releasably engaged with the nozzle and that terminates in a plurality of bristles, the second working area having a different construction than the first working area;

wherein the nozzle is selectively and releasably engageable with the first applicator to apply the viscous fluid from the nozzle onto the first working area for application of the viscous fluid by the first working area and the second applicator to apply the viscous fluid from the nozzle onto the second working area for application of the viscous fluid by the second working area.

2. The kit of claim 1 wherein the nozzle engaging structure of each of the first and second applicators includes a body and a rim protruding from the body defining an opening for receivably engaging the nozzle.

3. The kit of claim 2 wherein the applicator engaging structure includes a rib and the rim of each of the first and second applicators defines a slot, the rib selectively receivable by the slot of the first applicator and the slot of the second applicator.

4. The kit of claim 3 wherein the rib extends in a direction parallel to a longitudinal axis of the nozzle.

5. The kit of claim 4 wherein the slot defined by the first applicator extends parallel to the longitudinal axis of the nozzle when the first applicator is engaged with the nozzle and wherein the slot defined by the second applicator extends parallel to the longitudinal axis of the nozzle when the second applicator is engaged with the nozzle.

6. The kit of claim 1 wherein the nozzle engaging structure of each of the first and second applicators includes a body and a rim protruding from the body defining an opening for receivably engaging the nozzle, and wherein the nozzle engaging structure of the second applicator further includes a pair of reinforcing ribs protruding from the body of the second applicator defining a channel for receivably engaging the nozzle.

7. The kit of claim 6 wherein the applicator engaging structure includes a rib and the rim of each of the first and second applicators defines a slot for slidably engaging the rib, the rib extending in a direction parallel to a longitudinal axis of the nozzle.

8. The kit of claim 7 wherein the slot defined by the first applicator extends parallel to the longitudinal axis of the nozzle when the first applicator is engaged with the nozzle and wherein the slot defined by the second applicator extends parallel to the longitudinal axis of the nozzle when the second applicator is engaged with the nozzle.

9. The kit of claim 1 wherein the first working area includes a beveled edge.

10. The kit of claim 1 wherein the second working area comprises a brush.

11. A kit for dispensing a viscous fluid from a container comprising:

(a) a nozzle for coupling to an outlet of the container defining a nozzle opening for dispensing the viscous fluid from the container, the nozzle including applicator engaging structure including a rib; and (b) a first applicator including nozzle engaging structure releasably engageable with the applicator engaging structure of the nozzle to releaseably secure the first applicator to the nozzle, the first applicator further including a first working area for spreading the viscous fluid dispensed by the nozzle, the nozzle engaging structure having a body and a rim protruding from the body defining an opening for receivably engaging the nozzle, the rim defining a slot for receivably engaging the rib of the applicator engaging structure, the first working area having a leading edge that is distal of the nozzle when the first applicator is releasably engaged with the nozzle; and a second applicator including nozzle engaging structure releasably engageable with the applicator engaging structure of the nozzle to releaseably secure the second applicator to the nozzle, the second applicator further including a second working area for spreading the viscous fluid dispensed by the nozzle, the second working area having a different construction than the first working area, the nozzle being selectively and releasably engageable with the first applicator to apply the viscous fluid from the nozzle onto the first working area for application of the viscous fluid by the first working area and the second applicator to apply the viscous fluid from the nozzle onto the second working area for application of the viscous fluid by the second working area, the nozzle engaging structure of the second applicator having a body and a rim protruding from the body defining an opening for receivably engaging the nozzle, the rim defining a slot for receivably engaging the rib of the applicator engaging structure, the second working area having a leading edge that is distal of the nozzle when the second applicator is releasably engaged with the nozzle and that terminates in a plurality of bristles.

12. The kit of claim 11 wherein the rib extends in a direction parallel to a longitudinal axis of the nozzle.

13. The kit of claim 12 wherein the slot defined by the first applicator extends parallel to the longitudinal axis of the nozzle when the first applicator is engaged with the nozzle and wherein the slot defined by the second applicator extends parallel to the longitudinal axis of the nozzle when the second applicator is engaged with the nozzle.

14. The kit of claim 13 wherein the nozzle engaging structure of the second applicator further includes a pair of reinforcing ribs protruding from the body of the second applicator defining a channel for receivably engaging the nozzle.

15. The kit of claim 11 wherein the first working area includes a beveled edge.

16. The kit of claim 11 wherein the second working area comprises a brush.

* * * * *